US011608952B2

(12) United States Patent
Patton

(10) Patent No.: US 11,608,952 B2
(45) **Date of Patent: *Mar. 21, 2023**

(54) SIMULATED FLAME DEVICE

(71) Applicant: The Great Texas Lantern Company LLC, Newport Beach, CA (US)

(72) Inventor: Douglas Patton, Newport Beach, CA (US)

(73) Assignee: The Great Texas Lantern Company LLC, Newport Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/242,154

(22) Filed: Apr. 27, 2021

(65) Prior Publication Data

US 2021/0247043 A1 Aug. 12, 2021

Related U.S. Application Data

(63) Continuation-in-part of application No. 16/725,778, filed on Dec. 23, 2019, now Pat. No. 10,989,380.

(60) Provisional application No. 62/798,879, filed on Jan. 30, 2019.

(51) Int. Cl.

| | |
|---|---|
| ***F21V 3/04*** | (2018.01) |
| ***F21Y 115/10*** | (2016.01) |
| ***F21S 10/04*** | (2006.01) |
| *F21Y 107/30* | (2016.01) |

(52) U.S. Cl.

CPC ..... *F21S 10/043* (2013.01); *F21V 3/049* (2013.01); *F21Y 2107/30* (2016.08); *F21Y 2115/10* (2016.08)

(58) Field of Classification Search

CPC ..... F21V 3/049; F21V 3/0625; F21L 9/00; F21L 19/00

See application file for complete search history.

(56) References Cited

U.S. PATENT DOCUMENTS

| | | | |
|---|---|---|---|
| 5,924,784 | A | 7/1999 | Chliwnyj et al. |
| 7,798,669 | B2 | 9/2010 | Trojanowski et al. |
| 7,824,051 | B2 | 11/2010 | Walter et al. |

(Continued)

FOREIGN PATENT DOCUMENTS

| | | | |
|---|---|---|---|
| GB | 346164 | A | 4/1931 |
| JP | 6176901 | B2 | 8/2017 |

(Continued)

OTHER PUBLICATIONS

Korea Intellectual Pretty Office, International Search Report and Written Opinion, dated May 19, 2020.

*Primary Examiner* — Karabi Guharay
(74) *Attorney, Agent, or Firm* — Ryan Dean; Umberg Zipser LLP

(57) ABSTRACT

Simulated flame devices are shown and described having first and second diffusers, each with a sheet having a series of lines etched or embedded on the sheet. A PCB is disposed behind the first and second diffusers and comprises a plurality of light sources disposed or embedded on the PCB. The first and second diffusers may wrap about the PCB to create a 360 degree effect, and the diffusers themselves act to stretch the light emanated from the light sources in a vertical direction. The use of the two diffusers along with changing a brightness of some or all of the light sources over time simulates a moving flame.

14 Claims, 5 Drawing Sheets

(56) References Cited

U.S. PATENT DOCUMENTS

| | | | | |
|---|---|---|---|---|
| 8,953,926 | B1 | 2/2015 | Kelly et al. | |
| 9,494,297 | B1 | 11/2016 | Nagengast et al. | |
| 9,689,544 | B2 | 6/2017 | Green, Jr. et al. | |
| 10,125,937 | B2 | 11/2018 | Green, Jr. et al. | |
| 10,240,736 | B2 | 3/2019 | Green, Jr. et al. | |
| 10,480,734 | B2 | 11/2019 | Green et al. | |
| 10,989,380 | B2 * | 4/2021 | Patton | F21V 3/049 |
| 2017/0307157 | A1 | 10/2017 | Green, Jr. et al. | |

FOREIGN PATENT DOCUMENTS

| | | | | |
|---|---|---|---|---|
| JP | 2019003773 | A | * | 1/2019 |
| JP | 2019003773 | A | | 1/2019 |
| KR | 100888955 | B1 | | 3/2009 |
| KR | 1020170025132 | A | | 3/2017 |
| WO | 2005028962 | A1 | | 3/2005 |

* cited by examiner

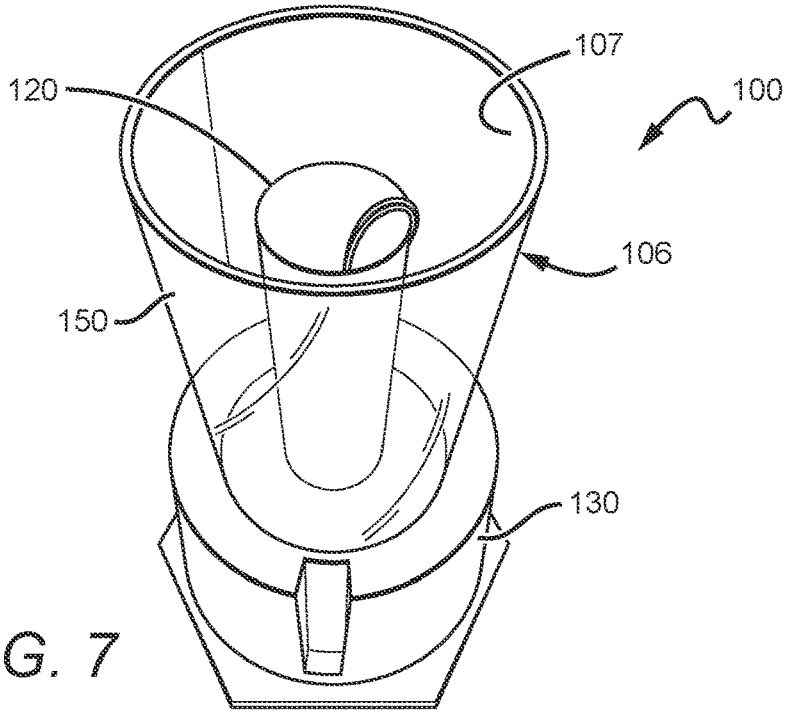
FIG. 7
FIG. 8
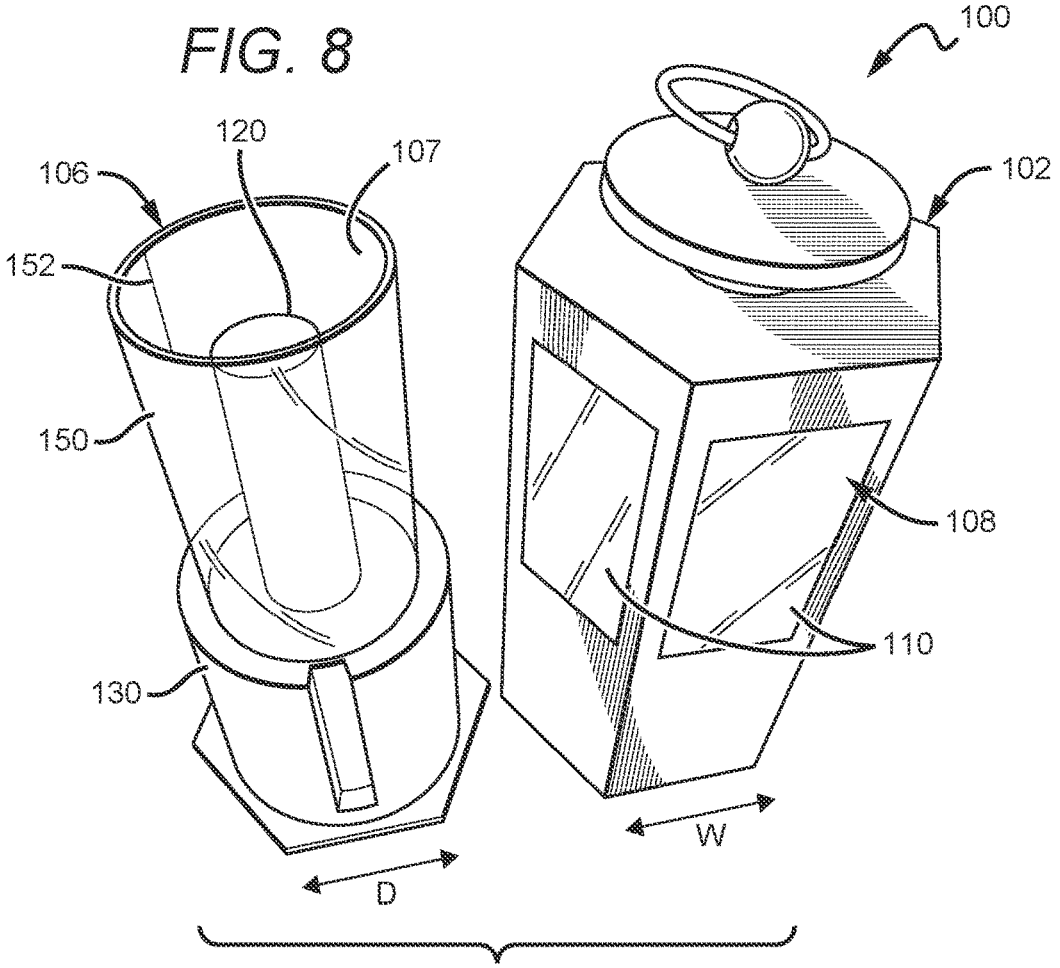

SIMULATED FLAME DEVICE

This application is a continuation-in-part application of U.S. non-provisional application having Ser. No. 16/725,778 filed on Dec. 23, 2019 (now U.S. Pat. No. 10,989,380), which itself claims priority to U.S. provisional patent application having Ser. No. 62/798,879 filed on Jan. 30, 2019. This and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is electrical lighting devices that simulate a flame.

BACKGROUND

The following description includes information that may be useful in understanding the present invention. It is not an admission that any of the information provided herein is prior art or relevant to the presently claimed invention, or that any publication specifically or implicitly referenced is prior art.

Various electrical lighting products currently exist, but none provide for a larger scale flame effect in a portable package. While electric fireplaces can produce a simulated flame, such devices are generally not portable and can be expensive.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for improved electrical lighting devices that simulate a flame.

SUMMARY OF THE INVENTION

The inventive subject matter provides apparatus, systems and methods in which a device comprises a plurality of light sources disposed on a flexible PCB that are each illuminated according to a program stored in a memory to create a 360 degree effect of moving flames. The use of a flexible PCB permits the PCB to be disposed in a cylindrical shape and disposing the light sources directly on the PCB helps to eliminates wires to simplify assembly. Although a single PCB is shown and described, it is contemplated that multiple PCBs could be used that may face in different directions without departing from the scope of the invention. Thus, for example, for a hexagonal shaped housing, it is contemplated that six PCBs could be used, or two PCBs each shaped into a semi-circle, for example.

It is also contemplated that a compound form of PCB sheet could be used having omg a different shape, such as a conical or ellipse shape that creates a different flame form.

First and second diffusers can be disposed about the plurality of light sources such that the light sources are viewed through both the first and second diffusers. The use of two diffusers rather than a single diffuser creates a more realistic flame effect, as the light sources illuminate in a steady or non-steady manner.

Each of the diffusers preferably comprises one or more sheets having a series of parallel, horizontal lines etched or embedded into each of the sheets. It is especially preferred that such lines are laser-etched into each sheet.

In other embodiments, it is contemplated that flat layers of PCB could be used with the light sources embedded on the PCB. Multiple layers of etched plastic (having a series of parallel lines) could be disposed on top of the flat layer(s) of PCB to create the flame effect described herein.

In still other embodiments, it is contemplated that undulating waveform layers of PCB could be used with the light sources embedded on the PCB. Corresponding undulating waveform layers of laser-etched plastic could be disposed on top of the PCB to create the flame effect described herein.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIGS. 6-7 are top and perspective views, respectively, of one embodiment of a diffuser sheet disposed about a plurality of light sources.

FIG. 8 is an exploded view of the simulated flame device of FIG. 1.

DETAILED DESCRIPTION

Figure 1:
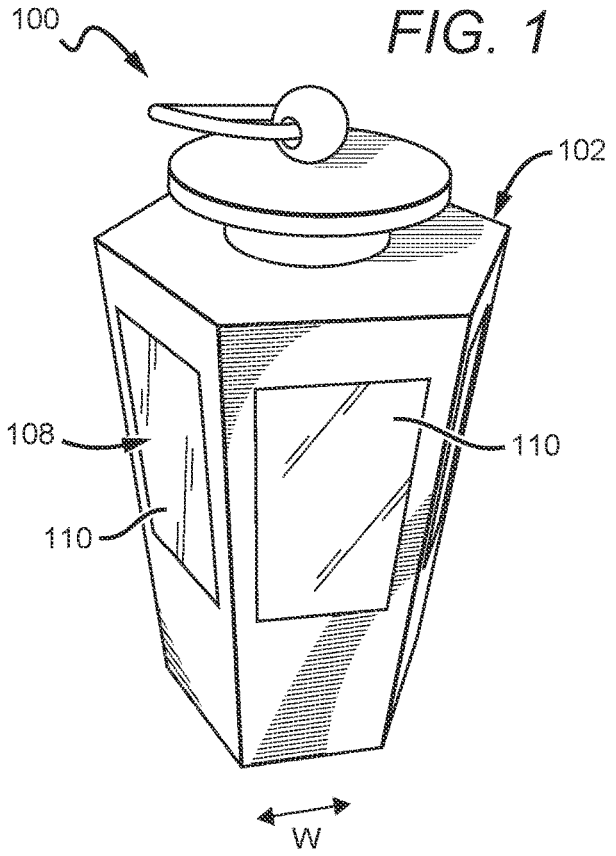
FIG. 1 is a perspective view of one embodiment of a simulated flame device.

Throughout the following discussion, numerous references will be made regarding servers, services, interfaces, portals, platforms, or other systems formed from computing devices. It should be appreciated that the use of such terms is deemed to represent one or more computing devices having at least one processor configured to execute software instructions stored on a computer readable tangible, non-transitory medium. For example, a server can include one or more computers operating as a web server, database server, or other type of computer server in a manner to fulfill described roles, responsibilities, or functions.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

FIGS. 1-10 illustrate one embodiment of a simulated flame device 100 disposed within a lantern housing 102. The housing 102 preferably comprises a second diffuser 108 which comprises a plurality of sheets 110 disposed in a hexagonal manner. However, it is contemplated that the sheets could be disposed about the interior to form different shapes including, for example, a square, a pentagon, a heptagon, an octagon, and so forth. It is especially preferred that each sheet 110 of the second diffuser 108 has a width that is approximately the same as the diameter of the first diffuser 106 disposed within the device 100. As used in this paragraph, the term approximately means within 15% of the value.

Rather than a lantern, it is contemplated that the same effect could be created in other apparatus. For example, the use of the diffusers placed in front of the light sources could be used in a flat surface, such as a painting or faux fireplace to create a wall of flames.

Figure 2:
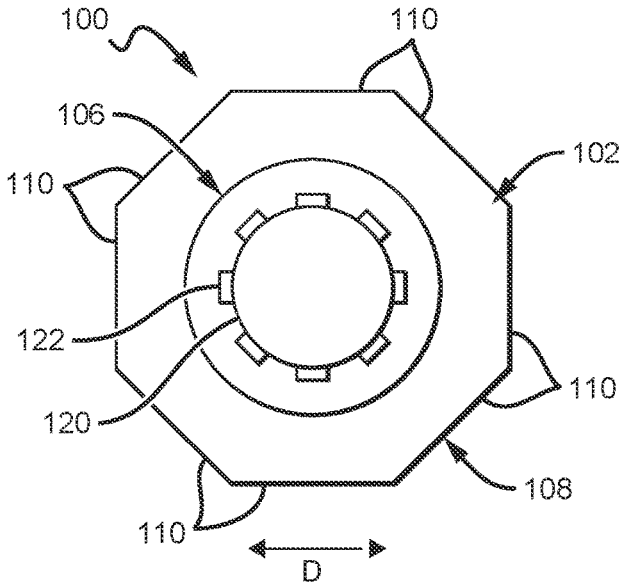
FIG. 2 is a horizontal cross-section view of one embodiment of a simulated flame device.

FIG. 2 illustrates a horizontal, cross-section schematic of the device 100 with housing 102 having a hexagonal shape. Housing 102 preferably comprises a set of sheets 110 that collectively form the second diffuser 108. Each of the sheets 110 are preferably composed of plastic and have a series of parallel, horizontal lines etched or embedded within each sheet.

Figure 6:
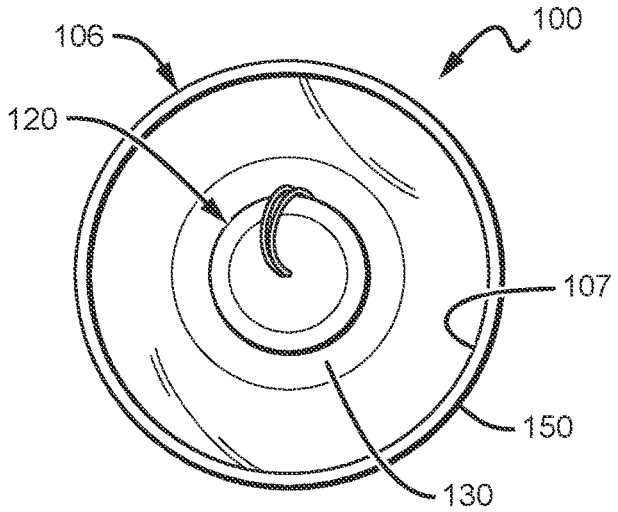
Figure 5:
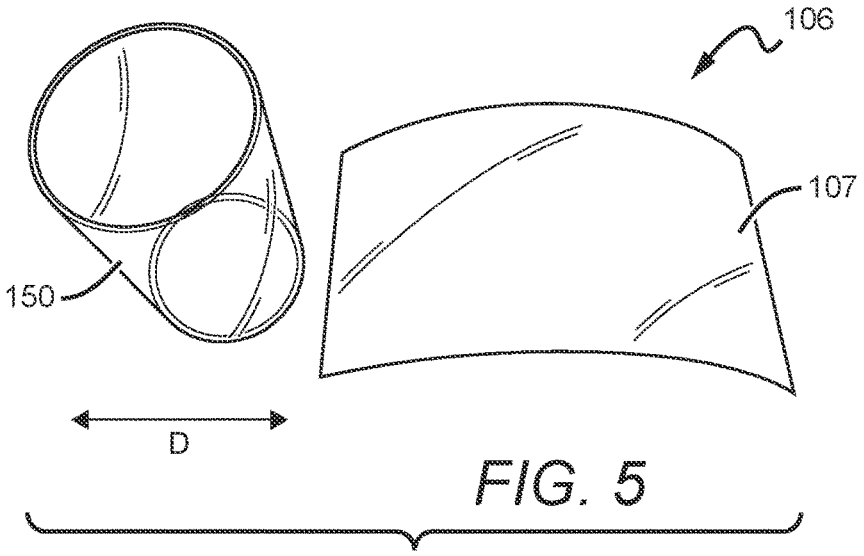
FIG. 5 is a top perspective view of one embodiment of a diffuser sheet and holder.
Figure 9:
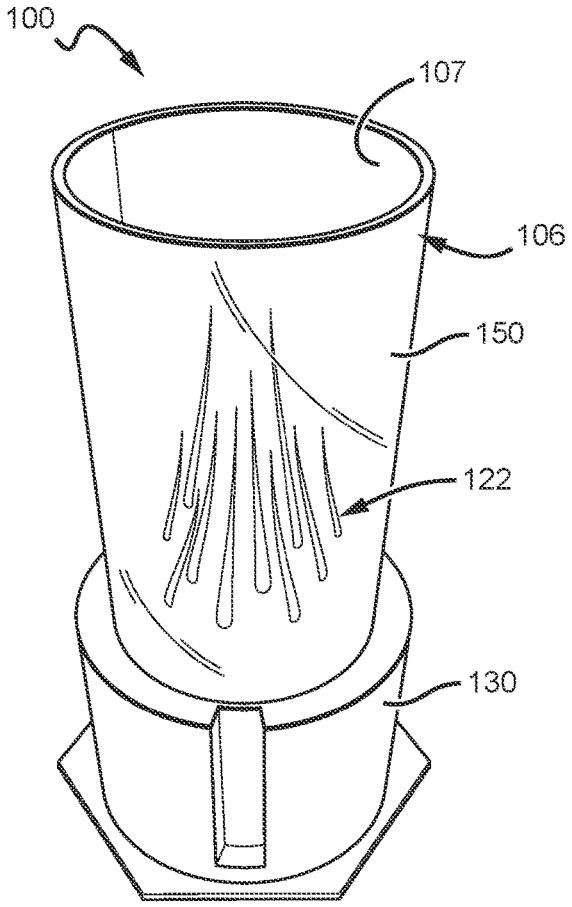
FIG. 9 is a perspective view of the diffuser sheet disposed about a plurality of light sources of FIG. 6 with some of the light sources illuminated.

A first diffuser 106 is disposed within the housing 102, such that the first diffuser 106 is surrounded by the second diffuser 108. As shown in FIGS. 5-7, the first diffuser 106 comprises a plastic cylindrical housing having a diameter D with a diffuser sheet 107 disposed within the cylindrical housing. Like the sheets 110, diffuser sheet 107 is preferably composed of plastic and has a series of parallel, horizontal lines etched or embedded within the diffuser sheet 107.

Figure 3:
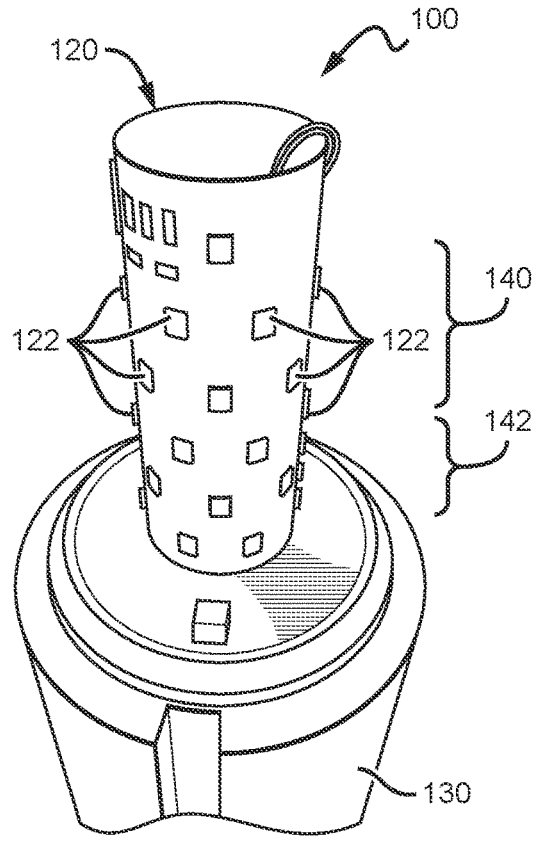
FIG. 3 is a perspective view of a PCB and plurality of light sources in one embodiment of the simulated flame device.
Figure 4:
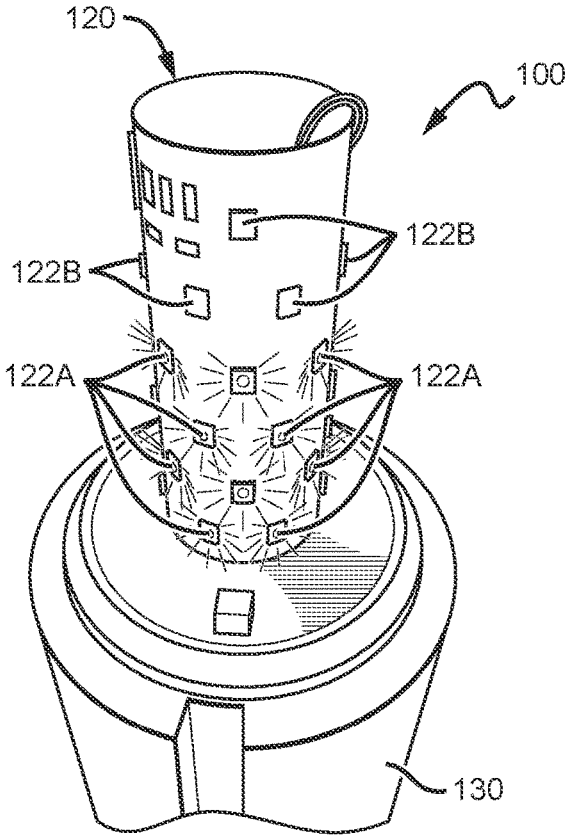
FIG. 4 is a perspective view of the PCB and plurality of light sources with some of the light sources illuminated.

Disposed within the first diffuser 106 is a PCB 120 on which a plurality of light sources 122 are disposed. An example of the arrangement of the plurality of light sources 122 on the PCB 120 is shown in FIGS. 3-4. It is preferred that the PCB 120 is flexible and shaped into a cylindrical shape.

Preferred light sources comprise LEDs that can be configured to blink in a controlled or uncontrolled manner. In some contemplated embodiments, the LEDs each emit light having the same color or wavelength. However, in other contemplated embodiments, it is contemplated that some of the LEDs could emit light having a different color or wavelength from others of the LEDs. In still further contemplated embodiments, some or all of the LEDs could be RGB LEDs such that a variety of wavelengths of light could be emitted and that can vary over time.

Thus, in some embodiments, it is contemplated that the plurality of light sources 122 could comprise RGB LEDs, which can illuminate in a pattern to imitate the colors of a flame. For example, the RGB LEDs at the bottom portion could illuminate a yellow light, the RGB LEDs at the middle portion could illuminate an orange light, and the LEDs at the top portion could illuminate a blue light.

Figure 10:
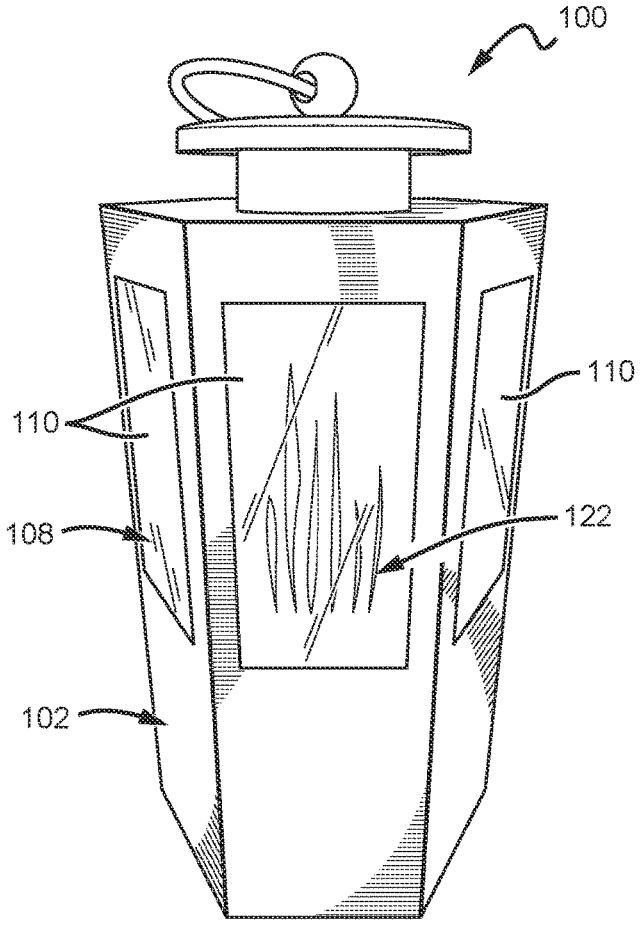
FIG. 10 is a perspective view of the simulated flame device of FIG. 1 with some of the light sources illuminated.

In this arrangement, the first and second diffusers 106, 108 create a two-stage diffuser window through which the plurality of light sources 122 can be viewed. The series of etched or embedded lines of each of the sheets 110 and diffuser sheet 107 create an effect that stretches the light from each of the plurality of light sources 122 vertically. This can be seen by comparing FIG. 4 where no diffuser is used to FIG. 9 where the light sources are viewed through the first diffuser 106 causing the light emanated to stretch vertically where the boundary of the light illuminated by each light source is thinner at the top than the bottom to form a tear-drop like shape. When the light sources 122 are viewed through the first and second diffusers 106, 108, as shown in FIG. 10, the light emanated from each of the light sources 122 is further diffused such that the light illuminated by each light source is thinner at the top and bottom and wider in the middle.

FIG. 3 illustrates an embodiment of a flexible PCB 120 coupled to a base 130. As discussed above, the PCB 120 preferably comprises a plurality of LEDs or other light sources 122 disposed on the PCB 120. The flexible PCB 120 is preferably formed into a cylindrical shape, although other shapes could be used. As shown, the light sources 122 are preferably disposed on the PCB 120 in a series of rows with each row having a set of light sources disposed in the row at a same height as the other light sources of that row. The PCB 120 shown in FIG. 3 has six rows, although fewer or additional rows of light sources could be used depending on the size and shape of the PCB 120, for example. The specific number of LEDs or other light sources per row may also vary depending on the size and shape of the PCB 120.

It is especially preferred that the light sources of one row are disposed in a staggered manner relative to the light sources of adjacent rows. In such arrangement, LEDs of the same column will be two rows apart. Of course, it is contemplated that the PCB could instead have additional light sources per row such that each row has a light source in the same column and the pattern of which light sources are illuminated and when may vary.

The PCB 120 is preferably connected with a processor and memory, which together determine the pattern/program for illuminating the plurality of light sources. In a simple manner, it is contemplated that each of the light sources can be illuminated and turned off at predetermined times according to a program stored within the memory. Preferably, one or more of the light sources blinks such that it turns on and off according to the program. It is especially preferred that some of the light sources blink more rapidly than others of the light sources. In addition, it is contemplated that some of the light sources may be illuminated or turned off for a longer period than others of the light sources.

In addition to simply turning on and off, it is contemplated that one or more of the light sources could vary in brightness rather than turning off (i.e., dimming or brightening) according to a stored program, and/or could vary in wavelength of light emitted.

The base 130 preferably is configured to receive a power source that can power the electronics of device 100. Such power source could be disposed batteries, a rechargeable battery, or electronics that permit a line voltage to be received. The base 130 is configured to hold the PCB 120 in place, and may contain a switch to power the device 100 on or off. In some embodiments, the base 130 may also contain a RF receiver, a Bluetooth transmitter, or other component to permit wireless control of the device 100.

In some embodiments, the plurality of light sources 122 can be grouped into an upper region (subset) 140 and a lower region (subset) 142. In such embodiments, it is contemplated that the lower subset 142 of light sources are configured to blink on and off at a first interval, and the upper subset 140 of light sources are configured to blink on and off at a second interval for a certain number of times that is then followed by a pause (i.e. turned off) for a third interval. Preferably, the third interval is greater than the first interval which is greater than the second interval. Put another way, the lower subset 142 of light sources blink at a reduced frequency than the upper subset 140 of light sources (when the light sources of the upper subset are illuminated).

It is especially preferred that all the lower subset 142 of light sources blink on and off at the first interval in a continuous manner. In contrast, only some of the upper subset 140 of light sources will be illuminated at any given moment. Of those that are illuminated, it is contemplated that they blink (or otherwise change brightness or color) in a different interval than the lower subset 142 of light sources, and preferably in a more rapid interval (i.e. blinking on and off more frequently). In some embodiments, the lower subset 142 of light sources may blink every 0.25 seconds.

One or more of the upper subset 140 of light sources preferably turn off for a third interval of time after a set number of iterations of blinking or otherwise varying a brightness of the light source.

In some embodiments, a group of the upper subset 140 of light sources can be illuminated. Over time, the specific group of light sources of the upper subset 140 can vary according to the program and in a pattern. For example, in one embodiment, the program could cause one or more light sources that are adjacent to the group of light sources to turn off while one or more others of the light sources that are adjacent to the group of light sources to turn on to thereby emulate moving flames.

Thus, it is contemplated that the plurality of light sources 122 could blink according to one or more patterns over time, which can each alter a frequency of how often and which of the light source illuminate and for how long, which will alter the faux flame effect. The patterns could comprise many variations that would sequentially initiate to generate a faux flame effect that appears more chaotic and natural.

FIG. 4 illustrates the PCB 120 of FIG. 3 with some of the light sources 122A illuminated, while others of the light sources 122B are turned off.

FIGS. 5-7 illustrates one embodiment of the first diffuser 106. As briefly discussed above, the first diffuser comprises a diffuser sheet 107 that is preferably composed of plastic and has a series of parallel, horizontal lines etched or embedded within each sheet. The etched lines are preferably continuous from one side to the opposing side of the sheet 107, but could be discontinuous. It is especially preferred that the lines are laser etched in the plastic sheet 107 to allow for close proximity of neighboring lines and reduce the width of each line. The etched lines create an effect that "stretches" the light from the light sources in a direction perpendicular to the direction of the etched lines. Thus, because the etched lines are disposed horizontally, the first diffuser 106 creates generally vertical lines of lights each having a variable width that is larger on the bottom than the top. However, if the etched lines were disposed vertically, this would cause the light emanated from the slight sources to "stretch" horizontally.

The diffuser sheet 107 is preferably disposed in a clear cylindrical tube 150, within which the PCB 120 can also be disposed. The clear, cylindrical tube 150 is preferably injection molded from plastic, although the specific material and manner of manufacture can vary. Tube 150 preferably has a diameter D. The diffuser sheet 107 is preferably disposed within the tube 150, such that the sheet 107 abuts an inner surface of the tube 150. Though less preferred, it is contemplated that the sheet 107 and tube 150 could form a single piece.

FIGS. 6 and 7 illustrates different views of the first diffuser 106 with the PCB 120 and plurality of light source 122 disposed concentrically within the first diffuser 106. As shown and described above, the first diffuser 106 comprises a clear, cylindrical tube 150 with a diffuser sheet 107 disposed against the inner surface of the tube 150.

FIG. 8 illustrates an exploded view of the various components of the device 100 described above. The PCB 120 and light sources can be disposed concentrically within the first diffuser 106, which comprises clear tube 150 having diffuser sheet 107 abutting an inner surface of the tube 150. First and second opposing edges of the diffuser sheet 107 meet at line 152. Base 130 is configured to maintain a relative position of the first diffuser 106 and the PCB 120, while also holding a power source, as well as memory and processor that are connected to the PCB 120.

The base 130, first diffuser 106 and PCB 120 are inserted within housing 102, preferably through a bottom opening. As discussed above, the housing 102 comprises the second diffuser 108, which consists of a set of diffuser sheets 110. For best effect, the width W of each diffuser sheet 110 (or at least the visible portion of the diffuser sheet) is approximately equal to the diameter D of the first diffuser 106. As light from the light sources 120 passes through the first and second diffusers 106, 108, the light is distorted and elongated. This can be seen by comparing FIG. 9 where only the first diffuser 106 is present to FIG. 10 where the first and second diffusers are present.

Preferably, the second diffuser 108 is separated from, and disposed about, the first diffuser 106, such that the first diffuser 106 and flexible PCB 120 are disposed within the second diffuser 108. Each of the sheets 110 are preferably separated by a space between adjacent ones of the sheets 110. In the embodiment shown, the space can be a non-opaque structure of the housing 102, where each of the sheets 110 are disposed within windows of the housing 102. In this manner, the degree of viewing of the effect is limited to generally where the light sources are located to avoid the darker side areas being viewed.

In some contemplated embodiments, it is contemplated that there could be a 0.25 inch spacing between the PCB 120 and the first diffuser 106, and a 0.5 inch spacing between the first and second diffusers 106, 108. In other words, a 1:2 ratio in relative spacing. Of course, the specific distances between components may vary depending on the size of the device 100, for example.

Figure 11:
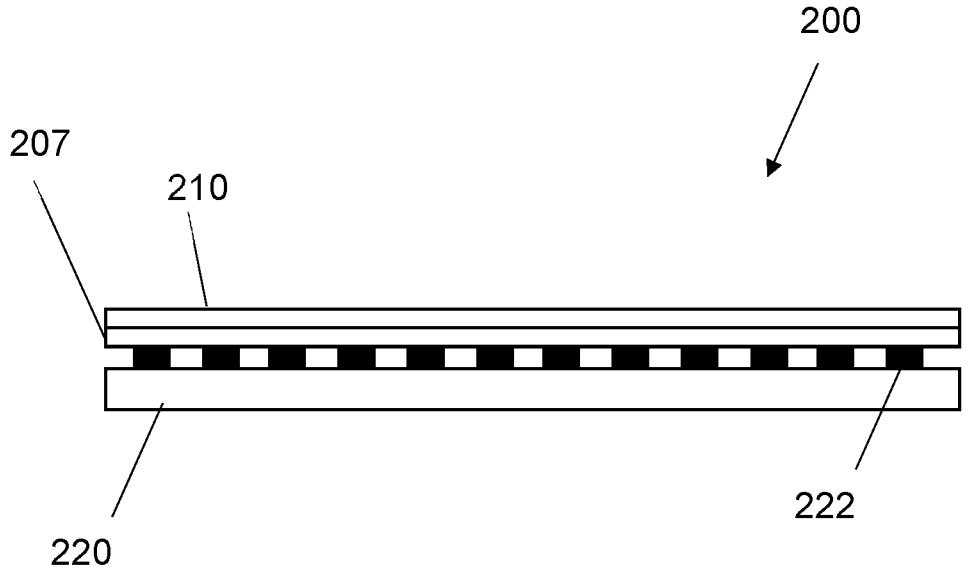
FIG. 11 is a side view of another embodiment of a simulated flame device.

FIG. 11 illustrates another embodiment of a simulated flame device 200 comprising a PCB 220 having a plurality of light sources 222 embedded on the PCB 220. A first diffuser 207 having a series of parallel lines etched into the first diffuser 207 can be layered on top of the PCB 220 and light sources 222. A second diffuser 210 having a series of parallel lines etched into the second diffuser 210 can be layered on top of the first diffuser 207. In this manner, the etched or otherwise provided parallel lines in each of the first and second diffusers 207, 210 thereby act to diffuse the light produced by one or more of the plurality of light sources 222 to create the flame effect described herein. By utilizing a flat PCB 220, the housing can be generally flat and in some cases rectangular to resemble a painting or fireplace.

Figure 12:
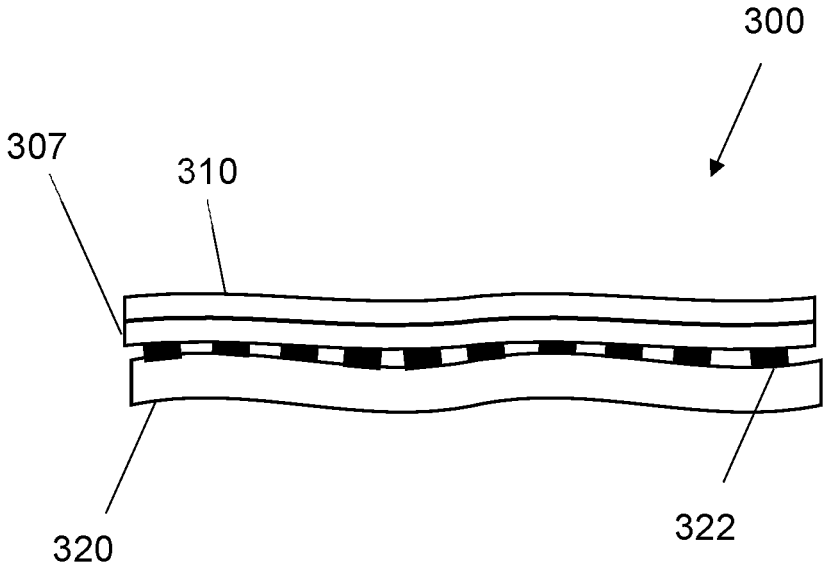
FIG. 12 is a side view of another embodiment of a simulated flame device.

FIG. 12 illustrates another embodiment of a simulated flame device 300 comprising an undulating PCB 320 having a plurality of light sources 322 embedded on the PCB 320. A first diffuser 307 having a corresponding undulating shape and a series of parallel lines etched into the first diffuser 307 can be layered on top of the PCB 320 and light sources 322. A second diffuser 310 having a corresponding undulating shape and a series of parallel lines etched into the second diffuser 310 can be layered on top of the first diffuser 307. In this manner, the etched or otherwise provided parallel lines in each of the first and second diffusers 307, 310 thereby act to diffuse the light produced by one or more of the plurality of light sources 322 to create the flame effect described herein.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A device, comprising:

a PCB having a plurality of light sources disposed or embedded on the PCB, wherein the PCB is coupled to a processor and a memory configured to store a program;

a first diffuser comprising a first sheet that is disposed in front of the PCB, wherein the first diffuser comprises a series of parallel lines etched or embedded into the first sheet;

a second diffuser disposed in front of the first diffuser, wherein the second diffuser comprises a series of parallel lines etched or embedded into the second sheet;

an outer housing disposed about the PCB and the first diffuser, and wherein the outer housing comprises a set of openings;

wherein the second diffuser comprises a set of plastic sheets, and wherein each of the plastic sheets are disposed within one of the openings of the outer housing;

wherein the first diffuser has a diameter and wherein a width of each plastic sheet of the second diffuser is approximately equal to the diameter of the first diffuser; and wherein at least some of the plurality of lights are configured to turn on and off by the processor according to the program.

2. The device of claim 1, wherein the plurality of light sources comprise LEDs disposed or embedded on the PCB.

3. The device of claim 1, wherein the plurality of light sources are disposed or embedded on the PCB in areas comprising an upper region and a lower region, wherein the plurality of lights disposed in the lower region are configured to blink on and off at a first interval, and wherein the plurality of lights in the upper region are configured to blink on and off at a second interval for a certain number of times that is then followed by a pause for a third interval, and wherein the third interval is greater than the first interval which is greater than the second interval.

4. The device of claim 3, wherein the plurality of lights disposed in the lower region are configured to blink on and off continuously while the device is powered on.

5. The device of claim 4, wherein only a subset of the plurality of lights in the upper region are illuminated simultaneously, and wherein the subset of the plurality of lights in the upper region that are illuminated simultaneously varies over time.

6. The device of claim 1, wherein the first and second diffusers each comprises a layer of etched plastic, and wherein the first diffuser is disposed on top of the PCB, and wherein the second diffuser is disposed in front of the first diffuser.

7. The device of claim 1, further comprising:

a housing having a base;

wherein the PCB is coupled to the base and configured to form a cylindrical shape;

wherein the first diffuser is disposed in front of at least a portion of the PCB to form a cylindrical shape, such that the PCB is disposed concentrically within the first diffuser sheet;

wherein the second diffuser is disposed in front of at least a portion of the first diffuser, such that at least the portion of the PCB and at least the portion of the first diffuser are disposed behind the second diffuser.

8. The device of claim 7, further comprising:

wherein each of the plastic sheets comprise a series of parallel lines etched or embedded into each of the plastic sheets.

9. The device of claim 7, further comprising:

a clear cylindrical tube coupled to and extending from the base in a vertical direction;

wherein the first diffuser is disposed within the cylindrical tube, such that the first diffuser is pressed against an inner surface of the cylindrical tube;

wherein the flexible PCB is disposed within the cylindrical tube, and wherein the first diffuser is disposed between the flexible PCB and the cylindrical tube.

10. The device of claim 1, wherein each of the plastic sheets comprising the second diffuser are separated by the housing which creates a space between adjacent ones of the plastic sheets.

11. The device of claim 1, wherein the plurality of light sources are disposed or embedded on the PCB in a series of rows, and wherein the light sources of a first row are staggered relative to the light sources of a second row, such that the light sources of the second row are not disposed directly above light sources of the first row.

12. The device of claim 1, wherein the plurality of light sources comprise RGB LEDs, and wherein the plurality of light sources are disposed or embedded on the PCB in areas comprising an upper region, a middle region and a lower region, and wherein the plurality of light sources in the lower region are programmed to emit a yellow light, wherein the plurality of light sources in the middle region are programmed to emit an orange light, and wherein the plurality of light sources in the upper region are programmed to emit a blue light.

13. The device of claim 1, wherein the first and second sheets each comprises a series of parallel, horizontal lines etched or embedded into the sheet.

14. The device of claim 1, wherein the first and second sheets each comprises one or more plastic sheets or layers.

* * * * *